US006571429B2

(12) United States Patent
Yeh

(10) Patent No.: US 6,571,429 B2
(45) Date of Patent: Jun. 3, 2003

(54) SIMPLE SUSPENSION CARRIER COMPONENT FOR BOTTLE PORTABILITY

(76) Inventor: Yu-Tsun Yeh, No. 270, Hsin Hsing Road, Ho Mei Chen, Chang Hua Hsien (TW)

( * ) Notice: Subject to any disclaimer, the term of this patent is extended or adjusted under 35 U.S.C. 154(b) by 0 days.

(21) Appl. No.: 09/984,696

(22) Filed: Oct. 31, 2001

(65) Prior Publication Data

US 2003/0079314 A1 May 1, 2003

(30) Foreign Application Priority Data

Oct. 12, 2001 (TW) ..... 90217416 U

(51) Int. Cl.[7] ..... A45F 5/00
(52) U.S. Cl. ..... 24/16 PB
(58) Field of Search ..... 24/16 R, 16 PB, 24/30.5 R, 543; 224/148.7, 148.4; 215/399; 248/312, 102; 294/27.1, 33, 31.2

(56) References Cited

U.S. PATENT DOCUMENTS 2,884,214 A * 4/1959 Wrobel ..... 248/74.3
3,942,750 A * 3/1976 Noorily ..... 248/74.3
4,609,171 A * 9/1986 Matsui ..... 248/74.3
5,711,465 A * 1/1998 Pittarelli et al. ..... 224/148.6
5,765,888 A * 6/1998 Stack ..... 294/27.1
5,890,635 A * 4/1999 Wu et al. ..... 224/148.4
5,954,247 A * 9/1999 Savine et al. ..... 224/148.4
6,086,124 A * 7/2000 Wang ..... 294/33
6,209,827 B1 * 4/2001 Kawai ..... 248/73

FOREIGN PATENT DOCUMENTS

JP 11301680 A * 11/1999 ..... B65D/23/00

* cited by examiner

*Primary Examiner*—James R. Brittain
(74) *Attorney, Agent, or Firm*—Troxell Law Office PLLC

(57) ABSTRACT

A simple suspension carrier component for bottle portability that is installed around the neck of a bottle to provide user convenience. The suspension component is of one-piece stretchable plastic construction. The suspension component has an open end consisting of a snap-lock recess with a passage formed in one extremity that accommodates the placement inside the snap-lock recess of an insertable hook disposed at its other extremity. A retaining bar is situated at the top edge of the snap-lock recess entrance, thereby constituting an engagement section after the insertable hook is slipped in and, furthermore, a pendant release button extends laterally parallel to the top side of the passage. The insertable hook has a curved back extremity that is angled upward and, furthermore, after the insertable hook is slipped into the snap-lock recess, the tip of the curved back extremity becomes engaged against the inner side of the retaining bar and the insertable hook cannot be drawn out to the rear. As such, the invention herein provides for toting convenience in a simple suspension carrier component for bottle portability that is of a straightforward structure and easy to operate.

2 Claims, 4 Drawing Sheets

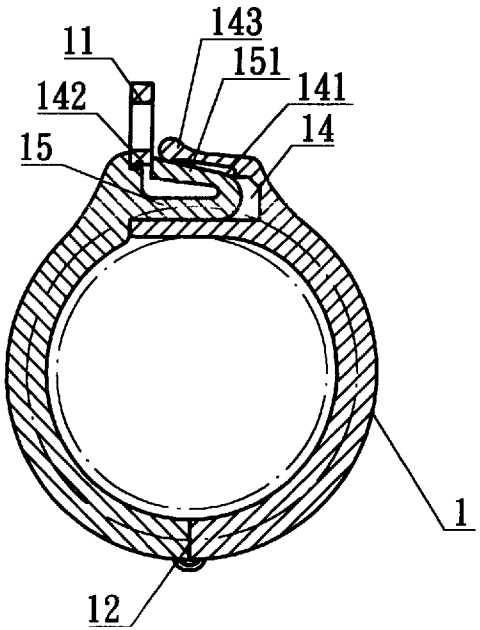
FIG3-C
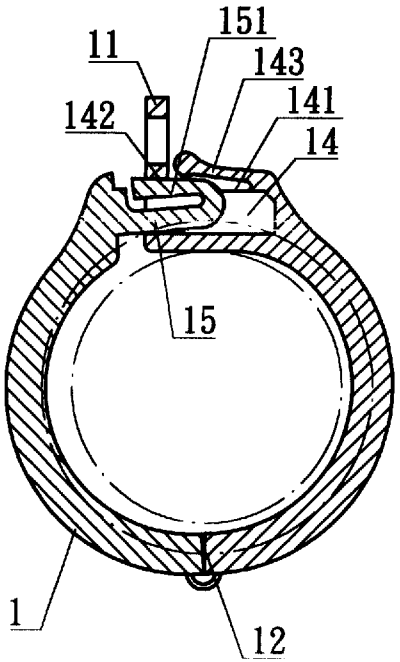
FIG3-B
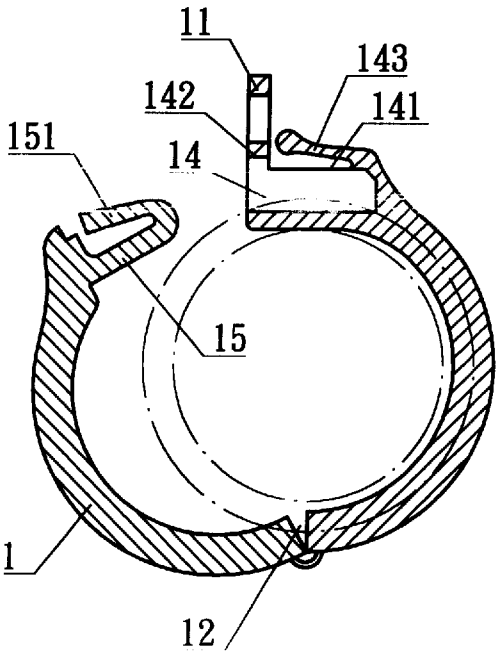
FIG3-A

SIMPLE SUSPENSION CARRIER COMPONENT FOR BOTTLE PORTABILITY

BACKGROUND OF THE INVENTION

1 Field of the Invention

The invention herein relates to a simple suspension carrier component for bottle portability in which a suspension component has an open end consisting of a snap-lock recess with a passage formed in one extremity that accommodates the placement within the snap-lock recess of an insertable hook disposed at its other extremity and, furthermore, after the insertable hook is slipped into the snap-lock recess, the tip of its the curved back extremity becomes engaged against the inner side of the retaining bar and the insertable hook cannot be drawn out to the rear; as such, the invention herein provides for toting convenience in a simple suspension carrier component for bottle portability that is of a straightforward structure and easy to operate.

2 Description of the Prior Art

Water intake must be regularly replenished during all indoor and outdoor activities. At present, exercisers purchase mineral water and soft drinks retail stores and small food outlets near outdoor activity areas to fulfill this need; however, since such drinks cannot always be completely consumed within a certain period, exercisers often have to carry them by hand as they continue along their routes, which inconveniences exercisers on the go.

SUMMARY OF THE INVENTION

The primary objective of the invention herein is to provide a simple suspension carrier component for bottle portability in which the suspension component has an open end consisting of a snap-lock recess with a passage formed in one extremity that accommodates the placement inside the snap-lock recess of an insertable hook disposed at its other extremity, wherein a retaining bar is situated at the top edge of the snap-lock recess entrance, thereby constituting an engagement section after the insertable hook is slipped in and, furthermore, a pendant release button extends laterally parallel to the top side of the passage; the insertable hook has a curved back extremity that is angled upward and, furthermore, after the insertable hook is slipped into the snap-lock recess, the tip of the curved back extremity becomes engaged against the inner side of the retaining bar and the insertable hook cannot be drawn out to the rear; as such, the invention herein provides for toting convenience in a simple suspension carrier component for bottle portability that is of a straightforward structure and easy to operate.

DETAILED DESCRIPTION OF THE INVENTION

FIG. 3-A is a cross-sectional drawing of the invention herein before insertional closure.

FIG. 3-B is a cross-sectional drawing of the invention herein during insertional closure.

FIG. 3-C is a cross-sectional drawing of the invention herein in the state of insertional closure.

Figure 4:
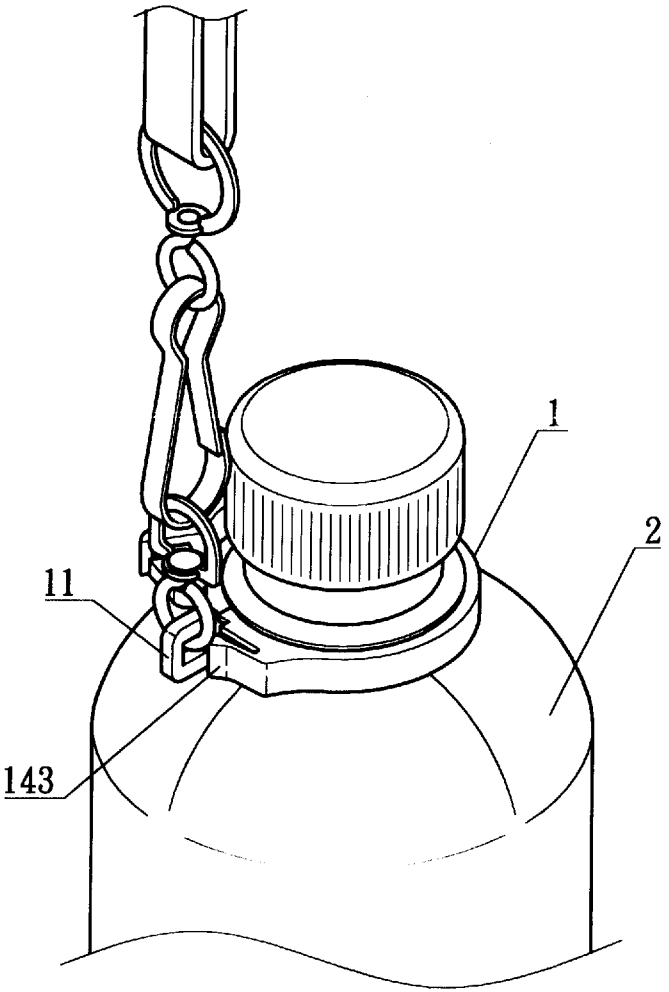

FIG. 4 is an isometric drawing of the invention herein as installed around the neck of a bottle and effectively suspending it during utilization.

DETAILED DESCRIPTION OF THE INVENTION

Figure 1:
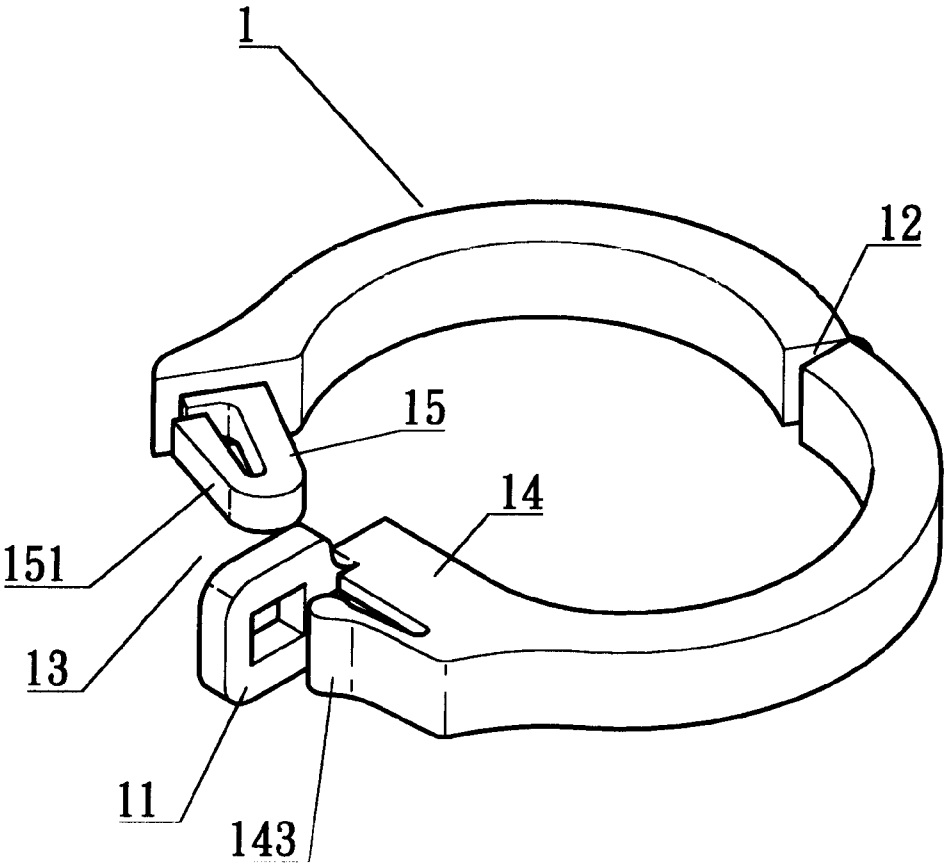
FIG. 1 is an exploded drawing of the invention herein.
Figure 2:
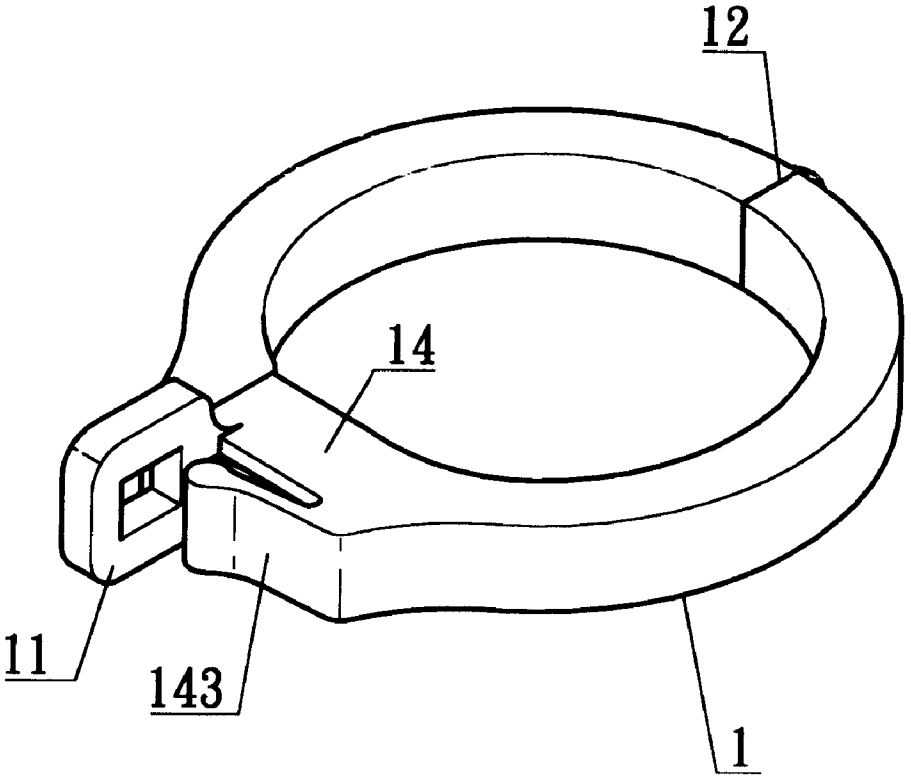
FIG. 2 is an isometric drawing of the invention herein.

Referring to FIG. 1 and FIG. 2, the structural arrangement of the invention herein, the said suspension component 1 is of one-piece stretchable plastic construction; the suspension component 1 has a lug 11 disposed at an appropriate position on its outer circumference for the insertion of a suspending cord and, furthermore, a flexile section 12 is formed in the outer circumference of the suspension component 1 and situated opposite from the flexile section 12 is an open end 13, with the said open end 13 consisting of a hollow snap-lock recess 14 at one extremity and an insertable hook 15 at its other extremity that fits into the snap-lock recess 14.

The said snap-lock recess 14 has a passage 141 formed in its upper extent and, furthermore, a retaining bar 142 is situated at the top edge of the recess entrance, thereby constituting an engagement section after the insertable hook 15 is slipped in; and a pendant release button 143 extends laterally parallel to the side of the passage 141.

The said insertable hook 15 has a curved back extremity 151 that is angled upward and, furthermore, of a plastic tensile structural arrangement such that after the insertable hook 15 is slipped into the snap-lock recess 14, the curved back extremity 151 becomes fixed inside the snap-lock recess 14 due to engagement against the retaining bar 142.

As for the operation of the present invention; referring to FIG. 3, before the insertional closure of the two extremities of the suspension component 1, the flexile section 12 is not flush such that the open end 13 is spread apart, while the curved back extremity 151 of the insertable hook 15 is at a slightly upward angle (as indicated in FIG. 3-A).

When the insertable hook 15 of the suspension component 1 is slid into the snap-lock recess 14, the curved back extremity 151 angling up from the insertable hook 15 is compressed downward (as indicated in FIG. 3-B) due to the constriction of the retaining bar 142; after the insertable hook 15 is completely admitted through, the curved back extremity 151 is set free from the constricting action of the retaining bar 142 and rebounds back to its upwardly angled state such that the tip of the curved back extremity 151 becomes engaged against the inner side of the retaining bar 142 and the insertable hook 15 cannot be drawn out to the rear, thereby providing for the effective suspension of a bottle 2 by its neck (as shown in FIG. 3C).

When uncoupling the two extremities of the suspension component 1 is desired, the user presses down the release button 143; since the insertable hook 15 is at the bottom end of the release button 143, its curved back extremity 151 is driven downward by the release button 143 and disengaged from the retaining bar 142, at which time the insertable hook 15 is withdrawable from the snap-lock recess 14.

Referring to FIG. 4, the open end 13 of the suspension component 1 is installed around the neck of a bottle 2, allowing the user to carry it on the shoulders rather than holding it inconveniently with the hands; as such, the invention herein provides a simple suspension carrier component for bottle portability that is of a straightforward structure and easy to operate.

What is claimed is:

1. A simple suspension carrier for bottle portability, comprising: a suspension component of one-piece stretchable plastic construction with a flexile section formed in an outer circumference, and first and second extremities; a lug disposed at the first extremity of the suspension component for the insertion of a suspending cord and located opposite from the flexile section, the lug including a hollow snap-lock recess; an insertable hook at the second extremity that fits into the snap-lock recess; the snap-lock recess having a passage and a retaining bar situated at a top edge of an entrance of the passage thereby constituting an engagement section after the insertable hook is inserted into the recess; the insertable hook having a curved back extremity that is angled upward, such that after the insertable hook is inserted into the snap-lock recess, the curved back extremity becomes fixed inside the snap-lock recess due to engagement against the retaining bar; the suspension component including a pendant release button extending laterally parallel to a side of said passage, such that the release button is pressed down against the curved back extremity of the insertable hook to disengage it from the retaining bar inside the snap-lock recess.

2. The suspension carrier of claim 1, wherein, when the insertable hook of the suspension component is inserted into the said snap-lock recess, the curved back extremity angling up from the said insertable hook is compressed downward due to contact with the retaining bar.

* * * * *